US011793324B2

(12) United States Patent
Long

(10) Patent No.: US 11,793,324 B2
(45) Date of Patent: Oct. 24, 2023

(54) MATTRESS ASSEMBLY

(71) Applicant: KING KOIL LICENSING COMPANY, INC., Willowbrook, IL (US)

(72) Inventor: I. David Long, Willowbrook, IL (US)

(73) Assignee: KING KOIL LICENSING COMPANY, INC., Willowbrook, IL (US)

( * ) Notice: Subject to any disclaimer, the term of this patent is extended or adjusted under 35 U.S.C. 154(b) by 0 days.

(21) Appl. No.: 17/205,568

(22) Filed: Mar. 18, 2021

(65) Prior Publication Data

US 2022/0296002 A1 Sep. 22, 2022

(51) Int. Cl.
*A47C 27/15* (2006.01)
*A47C 27/05* (2006.01)

(52) U.S. Cl.
CPC ..... *A47C 27/15* (2013.01); *A47C 27/05* (2013.01)

(58) Field of Classification Search
CPC ..... A47C 27/15; A47C 27/05; A47C 27/002; A47C 31/105; A47C 21/02; A47C 21/022; A47C 31/02; A47G 9/0246
See application file for complete search history.

(56) References Cited

U.S. PATENT DOCUMENTS 149,758 A * 4/1874 Junge ..... A47C 23/005 5/722
2,326,441 A * 8/1943 Cunningham ..... A47C 27/05 5/737
3,283,345 A * 11/1966 Berck ..... A47C 31/02 5/490
3,308,490 A * 3/1967 Cacioppo ..... A47G 9/10 5/652
4,463,466 A * 8/1984 May ..... A47C 27/05 5/721
8,800,082 B2 * 8/2014 Kluft ..... A47C 27/056 5/717
2007/0251006 A1 11/2007 Kennett
2010/0269743 A1 * 10/2010 Marcangelo ..... D05B 11/00 5/498
2011/0094039 A1 4/2011 Tervo et al.
2015/0096127 A1 * 4/2015 Schiller ..... A47C 27/15 5/717
2018/0360228 A1 12/2018 Johannessen
2019/0150631 A1 * 5/2019 Pearce ..... B68G 7/00

FOREIGN PATENT DOCUMENTS

KR 10-2145186 8/2020
WO 2020-016733 1/2020

OTHER PUBLICATIONS

Search Regort & Written Opinion issued in Int'l Appl. No. PCT/US2022/017441 (2022).

* cited by examiner

*Primary Examiner* — Justin C Mikowski
*Assistant Examiner* — Alison N Labarge
(74) *Attorney, Agent, or Firm* — Barnes & Thornburg LLP

(57) ABSTRACT

A mattress having a flange construction for securing a border assembly is disclosed. The flange construction is formed of a material that is affixed along the perimeter of an upper surface of the mattress. The border assembly includes a flap material for binding the border assembly to the flange construction. The flap material may be adhered to the flange construction, thereby allowing the flange construction to anchor and secure the border assembly to the mattress.

11 Claims, 4 Drawing Sheets

MATTRESS ASSEMBLY

TECHNICAL FIELD

The present disclosure generally relates to mattress construction, and more particularly, to a flange perimeter construction for securing a border assembly along sidewalls of a mattress.

BACKGROUND

Mattress construction can involve assembling multiple layers of material to form the mattress. For example, a mattress may include a combination of one or more foam layers stacked atop one another to form a composite encasement. Each layer may be affixed to one another using an adhesive, such as a glue. Once the layers are in place, a side border assembly formed of a fabric material layer may be affixed to sidewalls along the perimeter of the mattress. In addition to providing a general aesthetic for the mattress, the border assembly serves several functions, including supporting the overall mattress construction. Particularly, the border assembly prevents layers from shifting and consequently coming out of alignment with the overall construction over extended use. As a result, the construction of the mattress remains even and straight along the edges.

SUMMARY

Embodiments presented herein disclose a mattress having a flange construction for securing a border assembly. The flange construction is formed of a material (e.g., a non-woven polyester fiber, a fabric material, etc.) that is affixed along the perimeter of the mattress. The border assembly is formed of a material comprising several layers, including an exterior embroidered layer and one or more interior layers. The border assembly further includes a flap material for binding the border assembly to the flange construction. The flap material may be adhered to the flange construction using a substance such as a glue. A center support flange construction material may further be affixed across the perimeter to further secure the flap material and provide a center support for the border assembly. Once adhered, the border assembly may be sewn to the mattress via the flap material.

DETAILED DESCRIPTION

Figure 1:
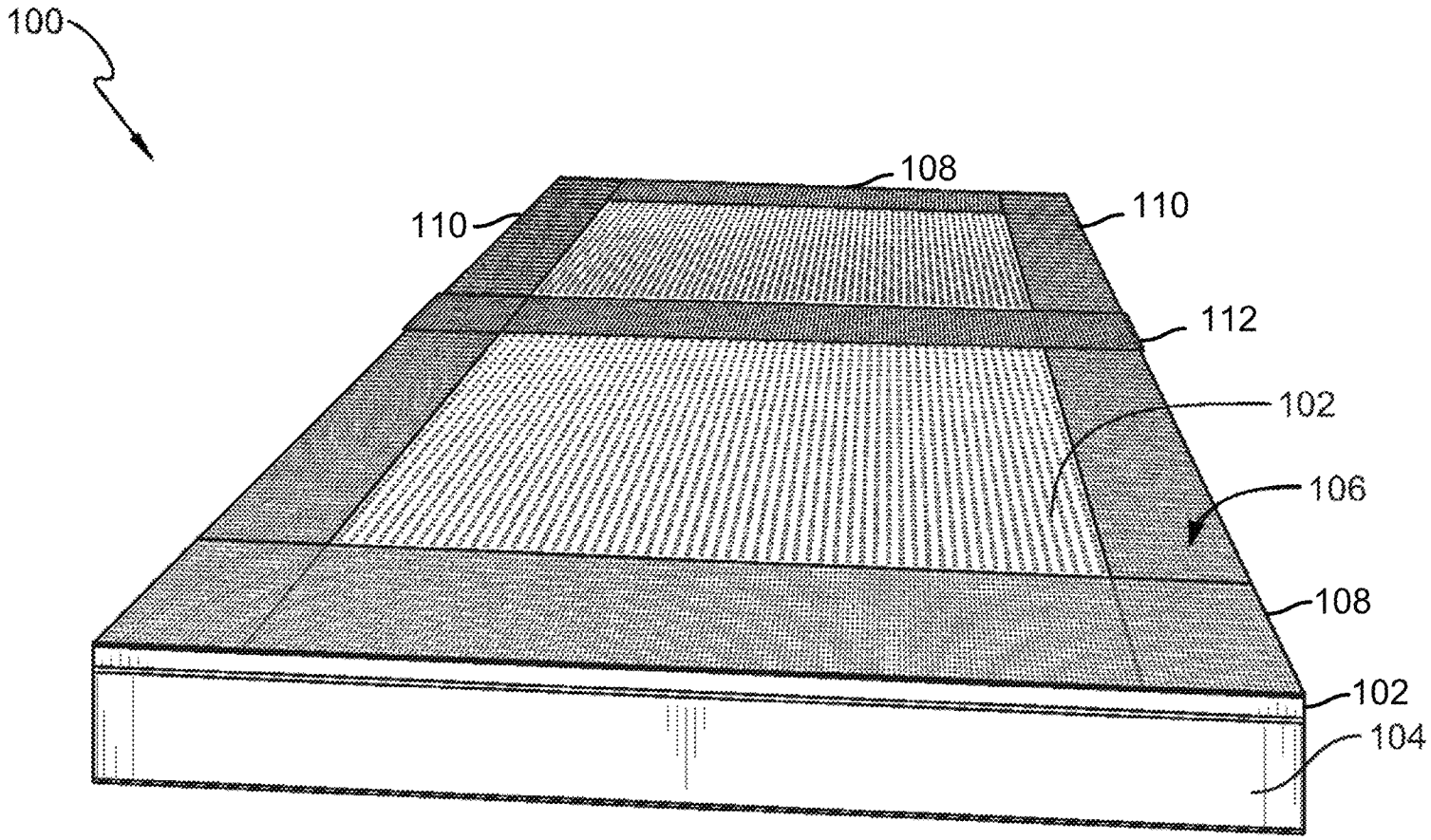
FIG. 1 illustrates a perspective view of a partially assembled mattress system having a flange construction, according to an embodiment.

While the present disclosure may be susceptible to embodiment in different forms, there is shown in the drawings, and described herein in detail, embodiments with the understanding that the present description exemplifies principles of the disclosure and does not intend to exhaust or limit the disclosure to the details of construction and the arrangements of components set forth in the following description and illustrated in the drawings. The present disclosure is described in connection with one or more contemplated embodiments which are not intended to be limiting of the scope of the present disclosure. The present disclosure is intended to encompass those embodiments as well as equivalents and variations.

Embodiments presented herein disclose a mattress trimline construction and method for assembling same. Particularly, in assembly, a mattress having multiple layers includes a thin material strip (e.g., a non-woven polyester fiber, a fabric material) (referred to herein as a "flange construction") that is affixed along a perimeter of an upper layer thereof. The flange construction receives a flap portion of a border assembly such that, when the border assembly is wrapped along a sidewall of the mattress, the flange construction more durably secures the border assembly along the sidewall.

Referring now to FIG. 1, a perspective view of a partially assembled mattress system 100 having a flange construction, according to an embodiment. The mattress system 100 may include a number of internal layers (not shown) extending upwardly from a base of the mattress and forming a sidewall 104 along the sides of the layers. The internal layers can include one or more foam layers serving as, e.g., a base layer, box layer, etc. Various types of foams may be used to form the layers, such as latex foam, polyurethane foam, viscoelastic foam, and so on. Other layers such as encasement layers providing a spring assembly, air bladder assembly, etc., may be included. In addition, the mattress provides an upper surface layer 102. Each of the layers may be adhered atop one another using a variety of techniques, such as glue, staples, sewing, or some combination. Illustratively, the mattress system 100 is shown as having a generally rectangular shape (though other shapes of the mattress system 100 may be contemplated), with the head of the bed depicted as the rear portion and the foot of the bed depicted as the frontal portion of the mattress system 100.

In an embodiment, a flange construction 106 may be formed along the perimeter of the upper surface layer 102 of the mattress system 100. As shown, the flange construction 106 may comprise multiple portions of a material strip (e.g., a non-woven 100% polyester fiber material, cloth material, fabric material, etc.) (also referred to herein as a "flange material") affixed (e.g., glued, sewn, stapled, and so on) along the perimeter of the upper surface layer 102 of the mattress system 100, extending from one edge of the mattress system and towards the center. The flange material may have a given length, e.g., approximately six inches. For example, FIG. 1 depicts two flange material portions 108 on head and foot rails of the mattress system 100, extending longitudinally across the edges of the foot and head of the mattress system 100. FIG. 1 also depicts two flange material portions 110 on side rails of the mattress system 100, extending laterally from the head to the foot on opposite sides of the mattress system 100. As also shown, the flange construction 106 may include a center flange material portion 112 extending longitudinally across the center portion of the mattress system 100 and overlapping with the flange material portions 110 placed along the side rails of the mattress system 100.

Figure 2:
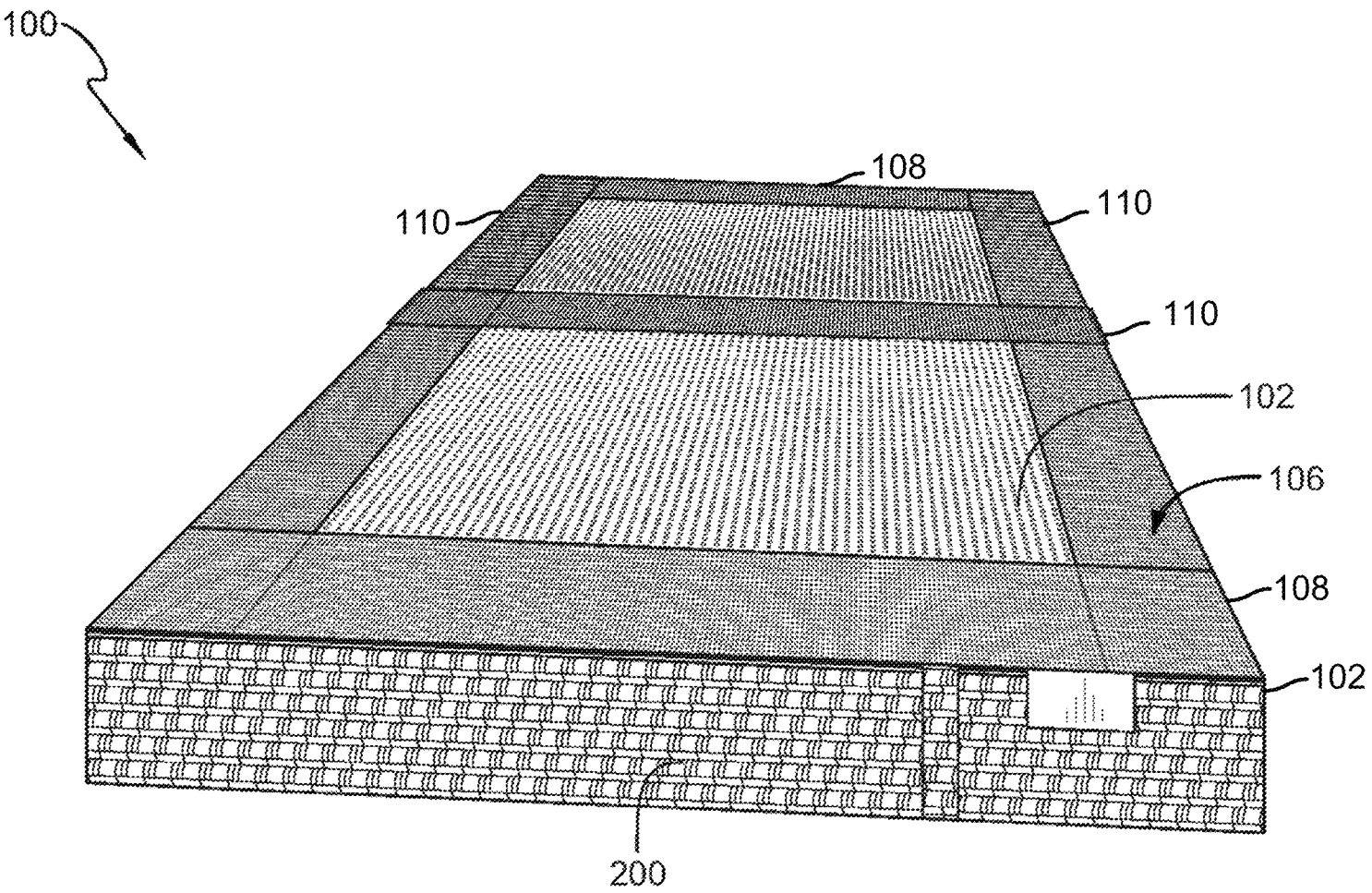
FIG. 2 illustrates a perspective view of a partially assembled mattress system having a side border assembly, according to an embodiment.
Figure 3:
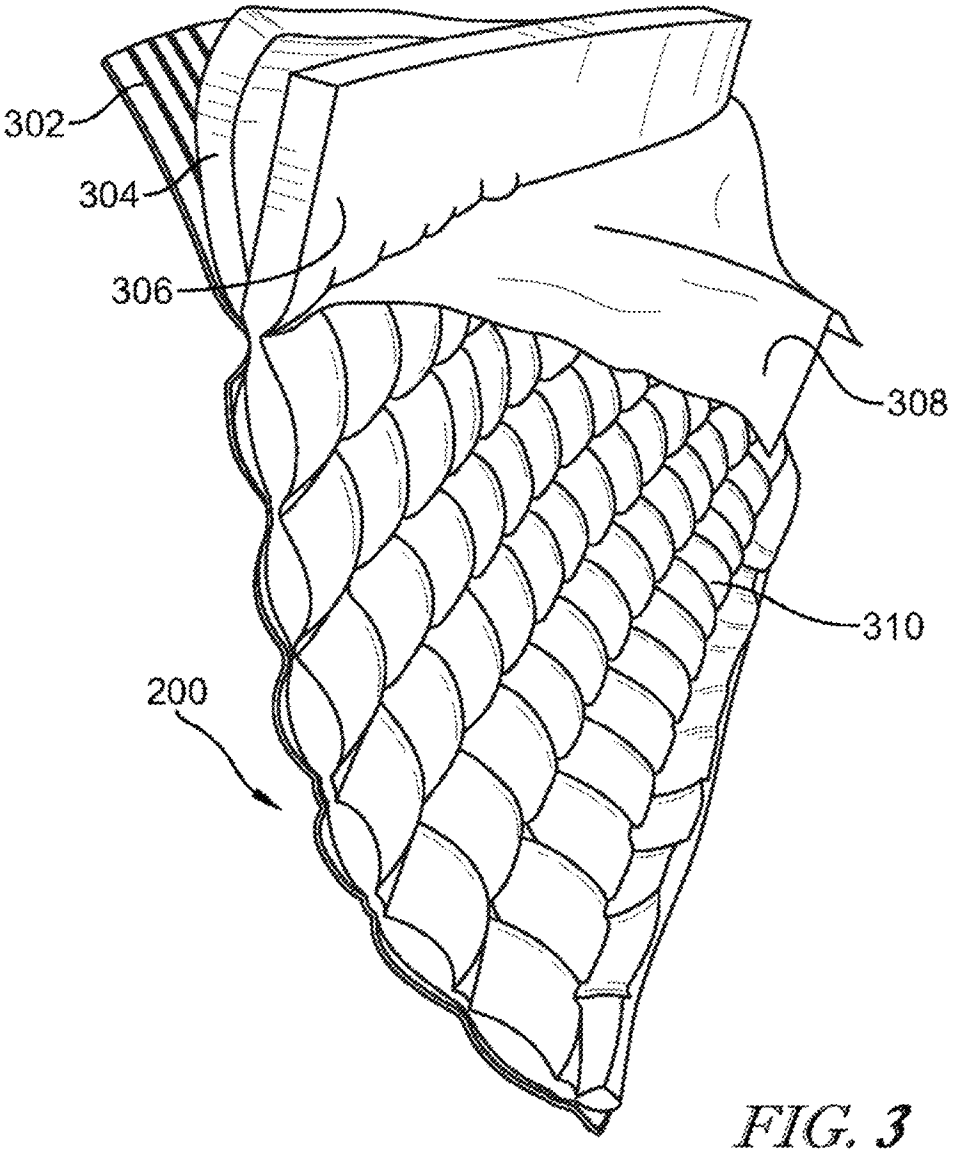
FIG. 3 illustrates a perspective view of an example side border assembly, according to an embodiment.

The flange construction 106 provides a support to allow a border assembly material to be attached to and further secured along the sidewall 104 of the mattress system 100. FIG. 2 depicts a perspective view of the partially assembled mattress system 100 in which a border assembly material 200 has been wrapped around the sidewall 104 of the mattress system 100. FIG. 3 depicts a portion of the border assembly material 200. As shown, the border assembly material 200 is a quilted material that may include a number of border layers, including an external layer 302, foam layers 304 and 306, and an interior layer 310. The border assembly material 200 may be placed around the sidewall 104 by the interior layer 310.

Figure 4:
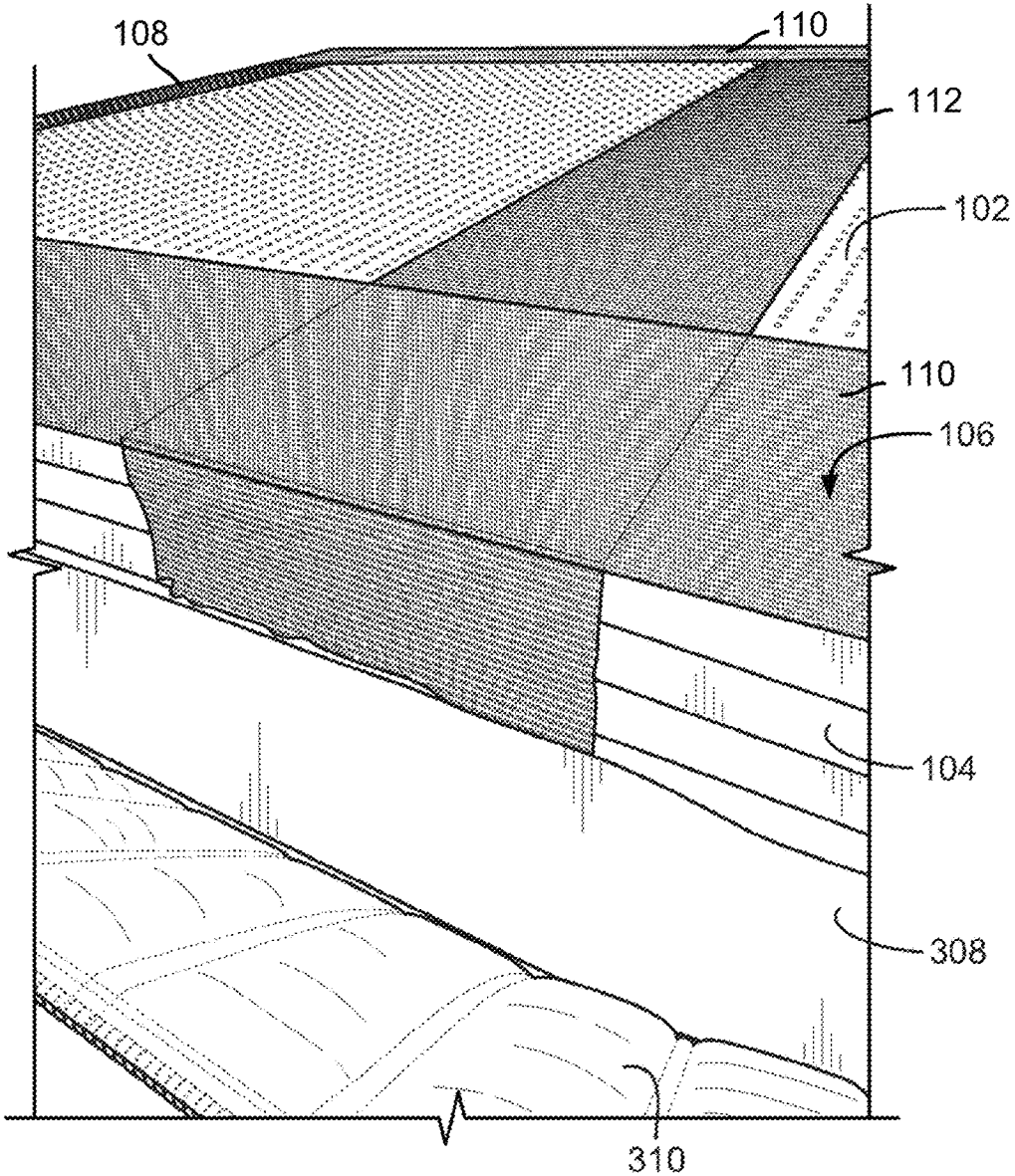
FIG. 4 illustrates a perspective view of the side border assembly attaching to the mattress via the flange construction, according to an embodiment.

Illustratively, the border assembly material 200 includes a flap material 308, which is a thin material that may be formed of, e.g., a cloth or fabric material and is attachable to the flange construction 106. The flap material 308 has an inner side that faces the interior layer 310 and an outer side facing the foam layer 306. FIG. 4 illustrates an example attachment of the flap material 308 to the flange construction 106 towards the center flange material portion 112. The flap material 308 may be affixed to the top of the flange construction 106, such as by gluing, sewing, stapling, or some combination thereof. For example, a glue may be applied to affix the inner side of the flap material 308 to the flange construction 106, and then the outer edges of the flap material 308 may be sewn along the outer edge of the flange construction 106 using a stitching thread. In assembly of the mattress system 100, the border assembly material 200 may be affixed to the flange construction 106 along the perimeter of the mattress system 100 until entirely wrapped around the mattress system 100. The flange construction 106 anchors and secures the border assembly material 200 firmly to the sidewall 104 of the mattress system 100. Doing so allows the border assembly material 200 to better preserve the form and alignment of the layer edges of the mattress system 100 more effectively compared to traditional approaches for attaching a border assembly to a mattress. With traditional approaches, the border assembly has a potential to loosen contact with the sidewall 104 over time and affect the alignment of the layer edges. Embodiments disclosed herein provide a flange construction to secure the border assembly material to the sidewall 104 of the mattress system.

In the foregoing description, numerous specific details, examples, and scenarios are set forth in order to provide a more thorough understanding of the present disclosure. It will be appreciated, however, that embodiments of the disclosure may be practiced without such specific details. Further, such examples and scenarios are provided for illustration only, and are not intended to limit the disclosure in any way. Those of ordinary skill in the art, with the included descriptions, should be able to implement appropriate functionality without undue experimentation.

References in the specification to "an embodiment," etc., indicate that the embodiment described may include a particular feature, structure, or characteristic. Such phrases are not necessarily referring to the same embodiment. Further, when a particular feature, structure, or characteristic is described in connection with an embodiment, it is believed to be within the knowledge of one skilled in the art to effect such feature, structure, or characteristic in connection with other embodiments whether or not explicitly indicated.

In the drawings, specific arrangements or orderings of elements may be shown for ease of description. However, the specific ordering or arrangement of such elements is not meant to imply that a particular order or sequence of assembly, or separation of processes, is required in all embodiments. Further, some connections, relationships, or associations between elements may be simplified or not shown in the drawings so as not to obscure the disclosure.

This disclosure is considered to be exemplary and not restrictive. In character, and all changes and modifications that come within the spirit of the disclosure are desired to be protected. While particular aspects and embodiments are disclosed herein, other aspects and embodiments will be apparent to those skilled in the art in view of the foregoing teaching.

While the foregoing is directed to embodiments of the present disclosure, other and further embodiments of the disclosure may be devised without departing from the basic scope thereof, and the scope thereof is determined by the claims that follow.

What is claimed is:

1. A mattress system comprising:

a mattress having a base, a plurality of layers extending upwardly from the base including an upper surface layer, and a sidewall;

a flange construction comprising a plurality of material strips formed of fabric covering one or more portions of the upper surface layer of the mattress and leaving another portion of the upper surface layer exposed, the plurality of material strips including one or more first material strips being affixed to and atop the upper surface layer along a perimeter thereof and including a second material strip being affixed to and across a center portion of the upper surface layer of the mattress; and a border assembly material having an external layer, one or more first foam layers, and a flap, the flap being attachable to the flange construction, the border assembly material wrapping around the sidewall and further secured thereto by an attaching of the flap to the flange construction.

2. The mattress system of claim 1, wherein each of the plurality of material strips is affixed over edges of the upper surface layer.

3. The mattress system of claim 2, wherein the second material strip is affixed longitudinally across a center of the upper surface layer.

4. The mattress system of claim 1, wherein the flap is attachable to the flange construction using a glue material.

5. The mattress system of claim 1, wherein the flap is attachable to the flange construction using an adhesive material to affix the flap to the flange construction.

6. The mattress system of claim 5, wherein the flap is further attachable to the flange construction by sewing the flap thereto.

7. The mattress system of claim 1, wherein the plurality of layers includes one or more second foam layers.

8. The mattress system of claim 1, wherein the plurality of layers includes one or more spring layers.

9. The mattress system of claim 1, wherein the border assembly material comprises a plurality of border layers including the flap.

10. A mattress system comprising:

a mattress having a base, a plurality of layers extending upwardly from the base including an upper surface layer, and a sidewall;

a flange construction formed of a fabric material, the flange construction being affixed to and atop the upper surface layer along a perimeter thereof, covering one or more portions of the upper surface layer of the mattress and leaving another portion of the upper surface layer exposed; the plurality of material strips including at least a material strip being affixed to and across a center portion of the upper surface layer of the mattress;

and a border assembly material having an external layer, one or more foam layers and a flap, the flap being attachable to the flange construction, the border assembly material wrapping around the sidewall and further secured thereto by the flange construction.

11. A mattress system comprising:

a mattress having a base, a plurality of layers extending upwardly from the base including an upper surface layer, and a sidewall;

a flange construction comprising a plurality of material strips formed of fabric affixed to and atop the upper surface layer along a perimeter thereof and covering one or more portions of the upper surface layer of the mattress and leaving another portion of the upper surface layer exposed, the plurality of material strips including at least a material strip being affixed to and across a center portion of the upper surface layer of the mattress; and a border assembly material comprising a plurality of border assembly material layers including an external layer, one or more foam layers, and a flap, the flap formed of a fabric material, the flap being attachable to the flange construction, the border assembly material wrapping around the sidewall and further secured thereto by the flange construction.

* * * * *